US010362855B2

(12) United States Patent
Whang et al.

(10) Patent No.: US 10,362,855 B2
(45) Date of Patent: Jul. 30, 2019

(54) ARMBAND FOR MOBILE DEVICE

(71) Applicant: Superior Communications, Inc., Irwindale, CA (US)

(72) Inventors: Sun Joon Whang, Pasadena, CA (US); Soo Park, Tustin, CA (US); Albert Frank Ventura, Redlands, CA (US); Mervyn Cheung, Alhambra, CA (US); George Chen, Chatsworth, CA (US)

(73) Assignee: Superior Communications, Inc., Irwindale, CA (US)

( * ) Notice: Subject to any disclaimer, the term of this patent is extended or adjusted under 35 U.S.C. 154(b) by 301 days.

(21) Appl. No.: 14/581,250

(22) Filed: Dec. 23, 2014

(65) Prior Publication Data

US 2015/0182009 A1 Jul. 2, 2015

Related U.S. Application Data

(60) Provisional application No. 61/922,764, filed on Dec. 31, 2013.

(51) Int. Cl.
*A45F 5/00* (2006.01)
*A45F 5/02* (2006.01)

(52) U.S. Cl.
CPC ..... *A45F 5/00* (2013.01); *A45F 2005/008* (2013.01); *A45F 2005/026* (2013.01); *A45F 2200/0516* (2013.01)

(58) Field of Classification Search
CPC ..... A45F 2005/008; A45F 2200/0516; A45F 2005/025; A45F 2005/026; A45F 2005/028; A45F 2200/0508
See application file for complete search history.

(56) References Cited

U.S. PATENT DOCUMENTS

| | | | | |
|---|---|---|---|---|
| 8,662,362 | B1 * | 3/2014 | Bastian | H04B 1/3888 224/197 |
| 8,749,200 | B2 * | 6/2014 | Huang | H02J 7/0042 248/346.04 |
| 2003/0155389 | A1 * | 8/2003 | Swartzentruber | A44C 5/12 224/164 |
| 2006/0011688 | A1 * | 1/2006 | Duncan | A45F 3/14 224/602 |
| 2007/0091557 | A1 * | 4/2007 | Kim | A45F 5/00 361/679.59 |
| 2008/0052800 | A1 * | 3/2008 | Nair | A45F 5/00 2/22 |
| 2008/0223889 | A1 * | 9/2008 | Rossell | A44C 5/0007 224/222 |
| 2012/0257346 | A1 * | 10/2012 | Hulet | H04M 1/04 361/679.32 |
| 2014/0054335 | A1 * | 2/2014 | Morgan | A45C 11/00 224/222 |
| 2014/0246551 | A1 * | 9/2014 | Springer | F16M 11/041 248/276.1 |

* cited by examiner

*Primary Examiner* — Justin Larson
(74) *Attorney, Agent, or Firm* — Snell & Wilmer LLP

(57) ABSTRACT

A system for mounting a mobile device to a wearer's arm, including a mobile device housing and an armband. The armband includes an elongate bistable spring movable between two positions to hold the armband to the wearer's arm. A clip may be joined to the armband, with the clip including slidable arms that extend across a diagonal of the mobile device.

20 Claims, 11 Drawing Sheets

ARMBAND FOR MOBILE DEVICE

RELATED APPLICATIONS

The present application claims the benefit of U.S. Provisional Application No. 61/922,764, filed Dec. 31, 2013, the entire disclosure of which is incorporated herein by reference.

BACKGROUND

Field

The present invention relates to an armband for securing mobile devices to a wearer.

Description of Related Art

Mobile devices, such as smartphones, iPods, and mobile audio devices, have accessories, such as armbands, to hold the device in place while exercising. Many of these armbands are cumbersome, difficult to secure, and do not stay in place while exercising. Furthermore, many of these armbands are only designed to be compatible with specific brands of phones or digital media players.

Thus, there is a need for an armband to hold mobile devices that is easy to secure, stays in place during exercises, and is capable of being used with multiple types of devices.

SUMMARY

The present application relates to a system for mounting a mobile device to a wearer's arm. The system may include a mobile device housing configured to hold the mobile device. The system may include an armband. The armband may include an elongate bistable spring having a first end and a second end and a length therebetween, the spring configured to move between a first position in which the spring forms a curve for extending about the wearer's arm to hold the armband to the wearer and a second position in which the spring is straightened from the first position to release the armband from the wearer's arm, the spring having an inner surface for facing the wearer's arm and an outer surface facing opposite the inner surface. The armband may include a material coupled to the spring and covering the inner surface and configured to draw moisture away from the wearer's arm. The armband may include a mount coupled to the spring and configured to releasably connect to the mobile device housing to mount the mobile device to the spring and hold the mobile device in a position radially outward from the spring when the spring is in the first position

BRIEF DESCRIPTION OF THE DRAWINGS

The features and advantages of the present application will become more apparent from the detailed description set forth below when taken in conjunction with the drawings, wherein.

DETAILED DESCRIPTION

Apparatus, systems and/or methods that implement the embodiments of the various features of the present application will now be described with reference to the drawings. The drawings and the associated descriptions are provided to illustrate some embodiments of the present application and not to limit the scope of the present application. Throughout the drawings, reference numbers are re-used to indicate correspondence between referenced elements.

Figure 1:
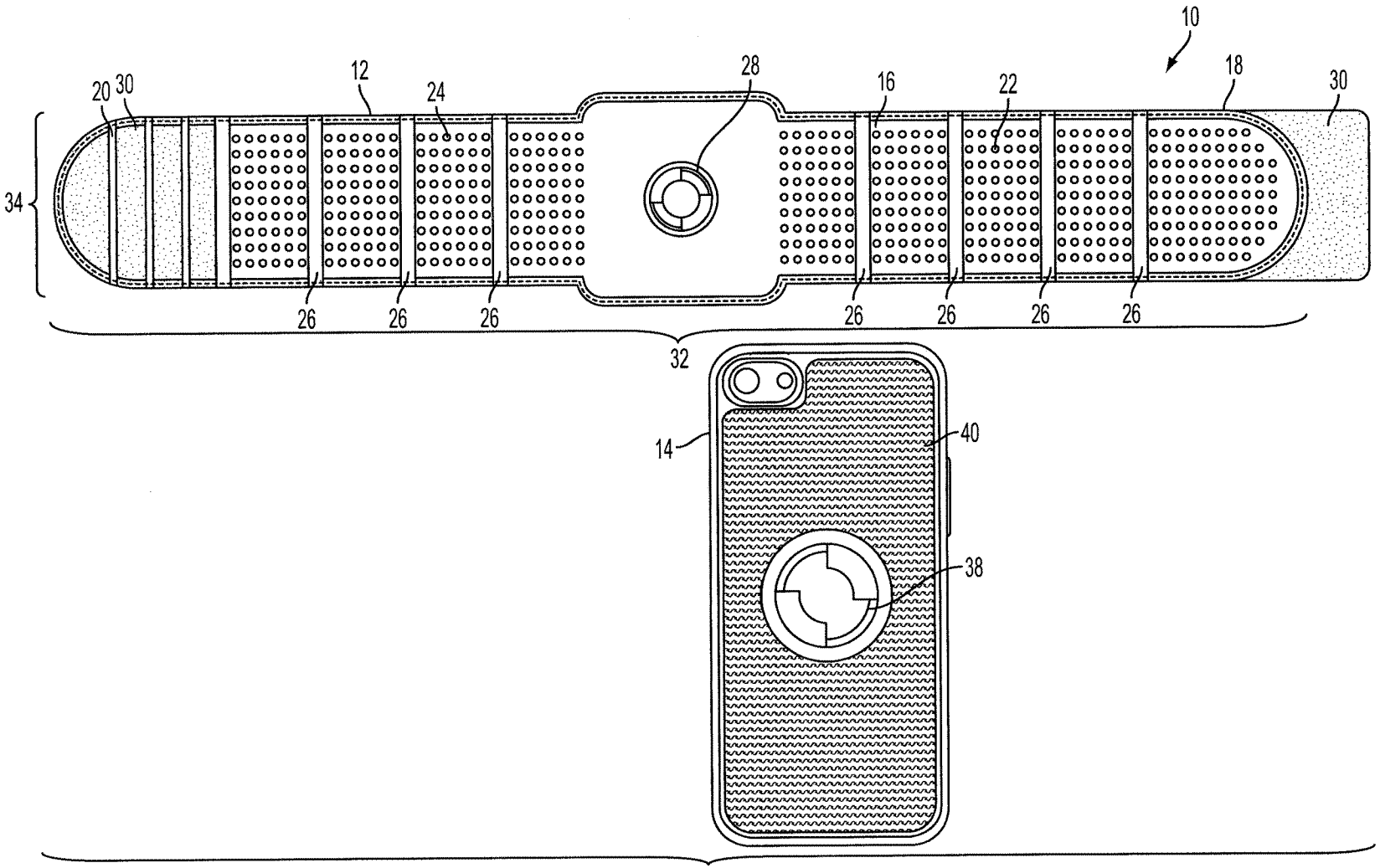
FIG. 1 is a front view of a system including an armband and a mobile device housing according to an embodiment of the disclosure.

FIG. 1 illustrates an embodiment of a system 10 for mounting a mobile device to a wearer's arm including an armband 12 and a mobile device housing 14. The armband 12 includes an elongate spring 16 extending from one end 18 of the spring 16 to another end 20 of the spring 16. A material 22 may cover an outer surface of the spring 16. The material 22 may include perforations 24 and reflective strips 26 positioned over the outer surface of the spring 16. A mount 28 is coupled to the spring 16 and may be positioned at a central location between the ends 18, 20 of the spring 16. Fasteners 30 may be positioned at the ends 18, 20 of the spring 16.

The spring 16 has a length 32 from one end 18 of the spring 16 to the other end 20 of the spring 16. The length 32 may be sized such that the spring 16 may extend around the bicep or upper arm of an individual, generally above the elbow. The length 32 may be sized such that one of the ends 18, 20 of the spring 16 overlaps another part of the spring 16 when the armband 12 is positioned around the wearer's upper arm. The overlapping parts of the spring 16 may enhance the uniformity of the radially inward force applied to the wearer's upper arm, when the armband 12 is positioned around the wearer's upper arm. The spring 16 may have a width 34 sized such that a sufficient amount of force from the spring 16 is exerted against the wearer's upper arm to hold the armband 12 in place when positioned around the wearer's upper arm. The width 34 may be less than the length 32. The length 32 may be between approximately 8 and 16 inches, and the width 34 may be between approximately 1 and 2 inches. In one embodiment, the width 34 may be approximately 1.5 inches. In one embodiment, the length and width may be varied from these dimensions as desired.

Figure 20:
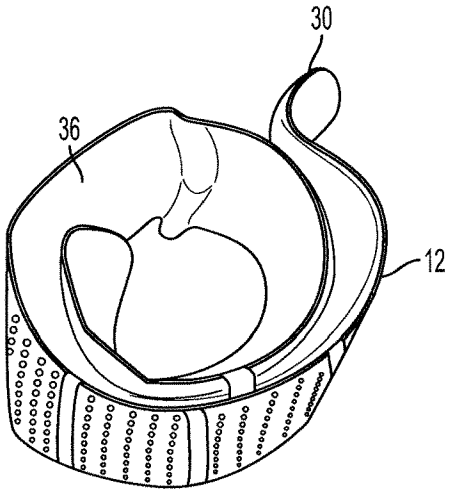
FIG. 20 is a front perspective view of the armband shown in FIG. 19, in a different position than shown in FIG. 19.

The spring 16 is a bistable spring as the spring may have two stable positions. One of the stable positions is the straightened position shown in FIG. 1, and the other is a coil position as shown in FIG. 20. The spring 16 may be disrupted from the stable position shown in FIG. 1 by a force being applied to the spring 16, which causes the spring 16 to draw itself towards the stable coil position. The spring 16 being drawn toward the stable coil position causes the spring 16 to exert a constrictive force against the wearer's arm to hold the armband 12 to the wearer's arm, as the spring 16 attempts to form the coil position shown in FIG. 20. Friction forces applied by parts of the armband 12 may also serve to hold the armband 12 to the wearer's arm. Preferably, the constrictive force applied by the spring 16 is sufficient to hold the armband 12 to the wearer's arm, without use of fasteners or other devices for securing, or otherwise releasably tethering the armband 12 to the wearer's arm. In one embodiment, the spring 16 may achieve the stable coil position and may utilize a friction force to hold the armband 12 to the wearer's arm, rather than utilizing a constrictive force applied by the armband 12.

The spring 16 may be returned to the stable position shown in FIG. 1 by a force being applied to the spring 16 to move the spring 16 away from the stable coil position that it is drawn to.

Figure 8:
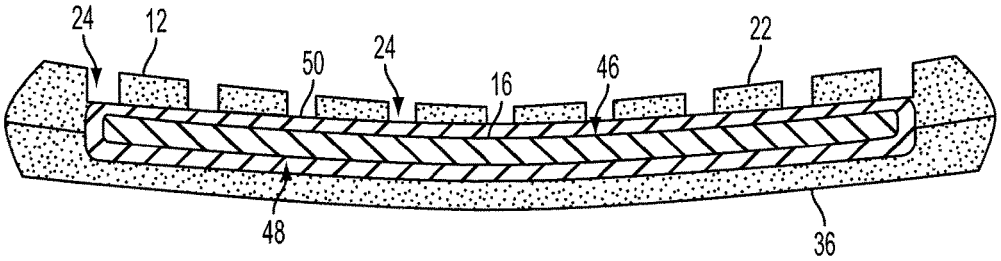
FIG. 8 is a cross sectional view of the armband along lines 8-8 in FIG. 3.

In the stable position shown in FIG. 1, the spring 16 has a shape in which the spring 16 extends substantially straight. The spring 16 has a shape in which no portion of the spring 16 overlaps another portion of the spring 16. The spring 16 in this configuration is positioned such that an axis may extend along the length 32 of the spring 16 between the ends 18, 20. The spring 16 may be maintained in the straightened position by a structural property of the spring 16, which may include a curvature of the spring 16 along the width 34 of the spring 16. Such a curvature is shown in FIG. 8, for example.

Figure 9:
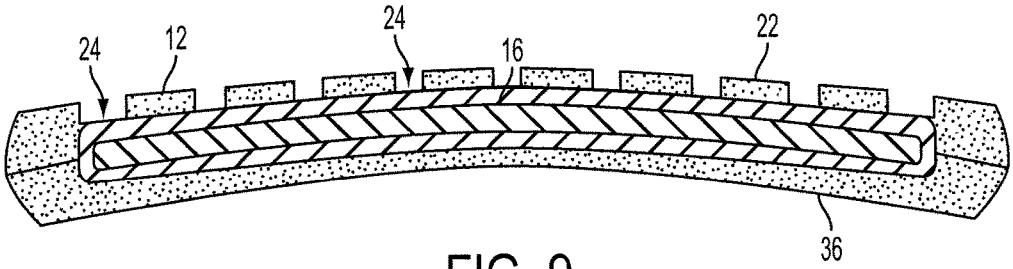
FIG. 9 is a cross sectional view of the armband along lines 8-8 in a different configuration than shown in FIG. 8.

Upon a force being applied to the spring 16 that disrupts the spring 16 from the straightened position shown in FIG. 1, the structural properties of the spring 16 cause the spring 16 to be drawn towards a coiled position, as shown in FIG. 20. The force may disrupt the curved shape shown in FIG. 8 such that the spring 16 achieves the curved shape shown in FIG. 9 and begins to form a coil. The spring 16, being drawn towards the coil shape, causes the spring 16 to apply a radially constrictive force against the wearer's arm.

The spring 16 is preferably sized such that when the spring 16 is drawn to the coiled state and is positioned around the wearer's upper arm, then one of the ends 18, 20 of the spring 16 overlaps another part of the spring 16. The size of the spring 16 allows a radial force to be applied around the entire circumference of the wearer's upper arm, to allow a more uniform distribution of constrictive force to be applied to the upper arm.

When the spring 16 is drawn to the coiled state and is positioned around the wearer's upper arm, a force is applied to the spring 16 to return the spring 16 to the substantially straightened position shown in FIG. 1. The force may disrupt the curved shape shown in FIG. 9 such that the spring returns to the curved shape shown in FIG. 8. The spring 16 is straightened from the coiled position that it desires as shown in FIG. 20, and releases the armband 12 from the wearer's arm.

The spring 16 may be made of a metal, or other material that allows for bistable properties of the spring 16. In one embodiment, the spring 16 may be made of a polymer, plastic, or other flexible material. The spring 16 is preferably made of a material providing sufficient constrictive force to the wearer's upper arm such that additional fasteners or other devices are unnecessary to hold the armband 12 to the wearer's arm. The spring 16 may be preformed such that it is stable in the straightened position shown in FIG. 1, and is drawn to the coil position shown in FIG. 20 upon a force being applied to the spring 16. The spring 16 may be preformed such that it is stable in the cross section shown in FIG. 8, and is drawn to the coil position shown in FIG. 20 upon the cross section bending to the cross section shown in FIG. 9. In one embodiment, the spring 16 may be formed in a different shape that allow for bistable properties of the spring 16.

The spring 16 shown in FIG. 1 has an elongate shape, with the length 32 being longer than the width 34. The spring 16 has curved or tapered ends 18, 20. In one embodiment, the spring 16 may have a different shape that still allows a constrictive force to be applied to the wearer's arm.

The material 22 may form a covering for the outer surface of the spring 16. The outer surface of the spring 16 is the surface of the spring that faces out of the page in FIG. 1. The material 22 may entirely cover the outer surface of the spring 16 aside from the presence of the perforations 24 in the material 22. In one embodiment, the material 22 may entirely cover the outer surface of the spring 16. In one embodiment, the material 22 may be used as material covering the inner surface of the spring 16. In one embodiment, the material 22 may cover the inner surface and outer surface of the spring 16, or may form a sleeve extending entirely over inner and outer surfaces of the spring 16.

The material 22 may be a protective material that shields the wearer or another individual from contact with the spring 16. In one embodiment, the material 22 may be a material serving to draw moisture away from the wearer's arm. The material 22 may serve to position moisture from the wearer's arm at the exterior of the armband 12, to allow for ease of evaporation. In one embodiment, the material 22 may serve to draw moisture away from the wearer's arm by drawing moisture from material 36, which may also be configured to draw moisture away from the wearer's arm. In one embodiment, the material 22 and material 36 in combination may form a sleeve extending partially or entirely over the spring 16.

The material 22 may be made of any durable and flexible fabric or material composite, such as a thin stretchable neoprene, compression fabric, mesh cloth, Lycra, or rubber. In an embodiment in which the material 22 serves to position moisture from the wearer's arm at the exterior of the armband 12, the material 22 may be any natural or synthetic fiber that is capable of wicking moisture away from the skin, such as wool, polyester, or Teflon. Wicking materials may include materials that encourage capillary action, that is, the material uses tube-shaped patterns to encourage water to move away from the skin and reduce moisture buildup. In one embodiment, the material 22 may be a smooth low friction material. The material 22 in this embodiment may be a polymer or plastic. The smooth material 22 may allow the material 36 to more easily slide over the smooth material 22 when the armband 12 is being positioned around the wearer's arm and after the armband 12 has already been positioned around the wearer's arm. In one embodiment, a different material may be used for the material 22.

The material 22 may include perforations 24 or apertures extending through the surface of the material 22, which may reduce the total weight of the material 22. In an embodiment in which the material 22 serves to draw moisture away from the wearer's arm, the perforations 24 may provide a greater number of edges or boundaries of material 22 that may allow for improved moisture evaporation. In an embodiment in which the material 36 draws moisture away from the wearer's arm, the perforations 24 may enhance the ability of material 36 to draw moisture away from the wearer's arm, as moisture drawn by material 36 may more easily be allowed to evaporate through perforations 24.

Reflective strips 26 may be coupled to material 22 and may be configured to reflect incident light such that the armband 12 is more visible to others. The strips 26 may extend in a direction along the width 34 of the spring 16, substantially perpendicular to the axis of the spring 16. The strips 26 may be spaced from one another and may extend parallel to each other. The strips 26 may be made of out a reflective material such as metal, a reflective form of plastic, a reflective fabric, or the like.

Fasteners 30 may be positioned at the respective ends 18, 20 of the spring 16. The fasteners 30 may include velcro, or hook and loop fasteners, buttons, adhesives, straps, or the like. The fasteners 30 may serve to provide additional securing of the armband 12 to the wearer's arm. The fasteners 30 may provide the additional securing even though the spring 16 may be strong enough to hold to the wearer's arm through a constrictive force. In one embodiment, no fasteners may be part of the armband 12. In this embodiment, the armband 12 may be secured around the wearer's arm solely based on the force applied by the spring 16 or a friction force of the armband 12 against the wearer's arm.

The mount 28 is a device for connecting the spring 16 to the mobile device housing 14. The mount 28 may be configured to releasably connect the spring 16 to the mobile device housing 14 to mount the mobile device to the spring 16. When the mobile device housing 14 is mounted to the spring 16 and the armband 12 is in position around the wearer's arm, the mount 28 may hold the mobile device in a position radially outward from the spring 16. The mount 28 may be configured as a protrusion extending outward from the spring 16 for the mobile device housing 14 to join to. The protrusion may have a shape that is keyed to mate with the mobile device housing 14. The shape may be keyed such that the protrusion forms a twist lock device that the mobile device housing 14 twists upon to lock the mobile device housing 14 to the spring 16. In one embodiment, the mount 28 may have a different shape or configuration that allows for connection to the mobile device housing 14.

Figure 4:
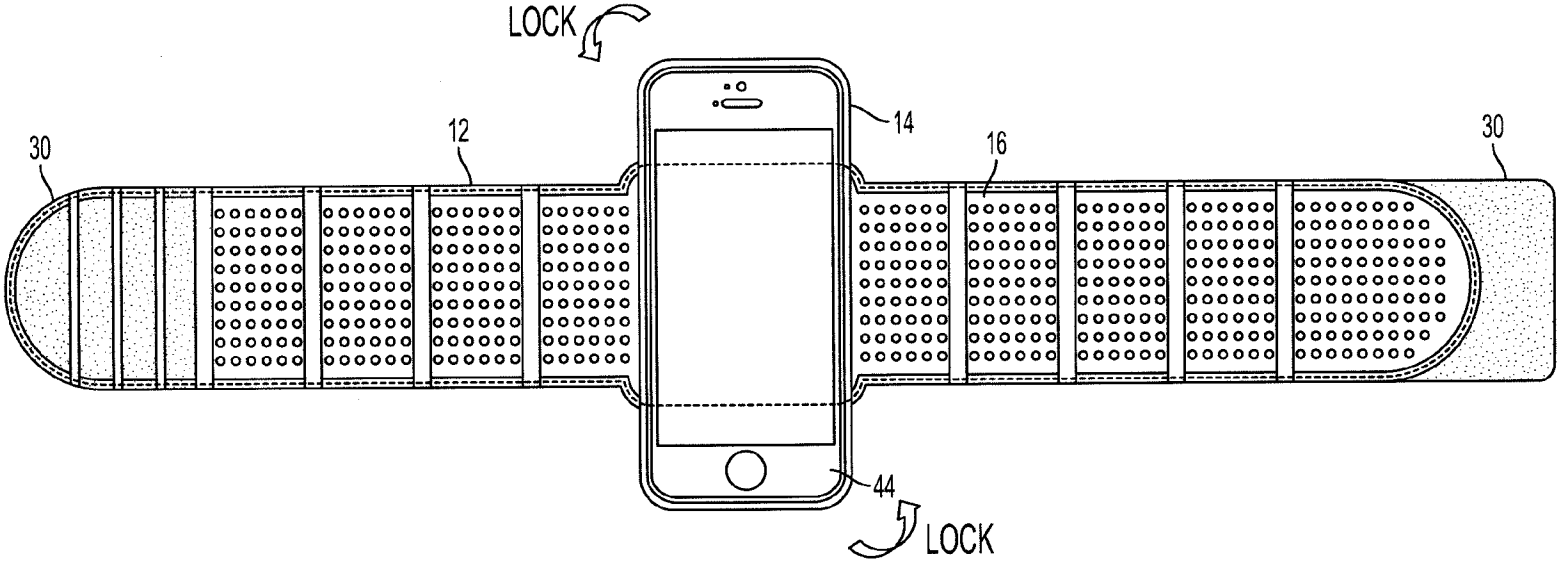
FIG. 4 is a front view of a representation of movement of the mobile device housing shown in FIG. 1.
Figure 5:
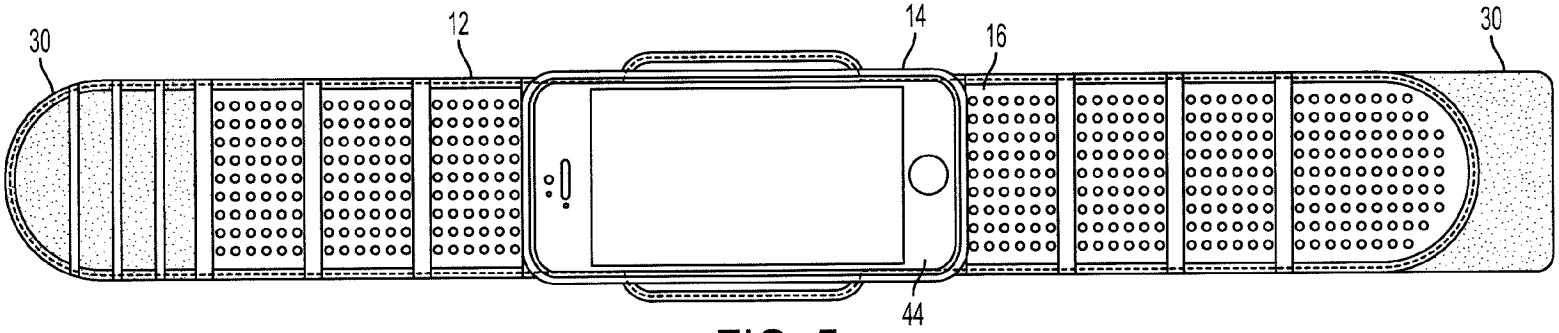
FIG. 5 is a front view of a representation of movement of the mobile device housing shown in FIG. 1.

The mobile device housing 14 is configured to hold the mobile device for securing to the spring 16. The mobile device housing 14 may be configured to join with the mount 28 to hold the mobile device to the spring 16. The mobile device housing 14 may be configured to releasably join the mobile device to the mount 28. The mobile device housing 14 may include a connector device 38 on a back surface of the mobile device housing 14 for the mount 28 to join to. The connector device 38 may have a shape that is keyed to mate with the protrusion of the mount 28. The shape may be keyed such that the protrusion forms a twist lock device with the protrusion of the mount 28, such that the mobile device housing 14 twists upon the protrusion to releasably connect or lock the mobile device housing 14 to the spring 16. The connector device 38 may include an aperture in the back surface of the mobile device housing 14 for the protrusion to enter for the mobile device housing 14 to releasably connect to the mount 28. The mobile device housing 14 may be positioned upon the mount 28 such that it extends substantially perpendicular with the axis of the spring 16. The mobile device housing 14 may then be rotated by approximately ninety degrees such that it extends substantially parallel to the axis of the spring 16. A stop may be positioned within the connector device 38 to prevent further rotation of the mobile device housing 14. The rotation of the mobile device housing is represented in FIG. 4. The resulting locked position of the mobile device housing 14 is represented in FIG. 5, with the mobile device and mobile device housing 14 extending substantially parallel to the axis of the spring 16. In one embodiment, the connector device 38 may have a different shape or configuration that allows for connection to the mount 28.

In the embodiment shown in FIG. 1, the mobile device housing 14 is configured as a case for the mobile device. The case may be a hard case made out of polycarbonate or the like. The case may be rigid. The case may be a form fit case that extends over the back and sides surfaces of the mobile device to protect the mobile device from impacts and scratches. The case may contour to the size of the mobile device. The case may leave a portion or all of the screen of the mobile device exposed. The wearer may directly touch the screen of the mobile device when the mobile device is inserted into the case. The aperture of the connector device 38 may be positioned such that the protrusion enters the back of the case, leaving enough space for the mobile device to be positioned within the case. In one embodiment, the connector device 38 may be configured such that the connector device 38 is substantially flat against the back surface of the case, and does not extend outward, so that the connector device 38 does not form a raised protrusion on the case. The back of the case may have a substantially flat profile. In this embodiment, the connector device 38 may be smooth with regard to the remainder of the case.

Figure 2:
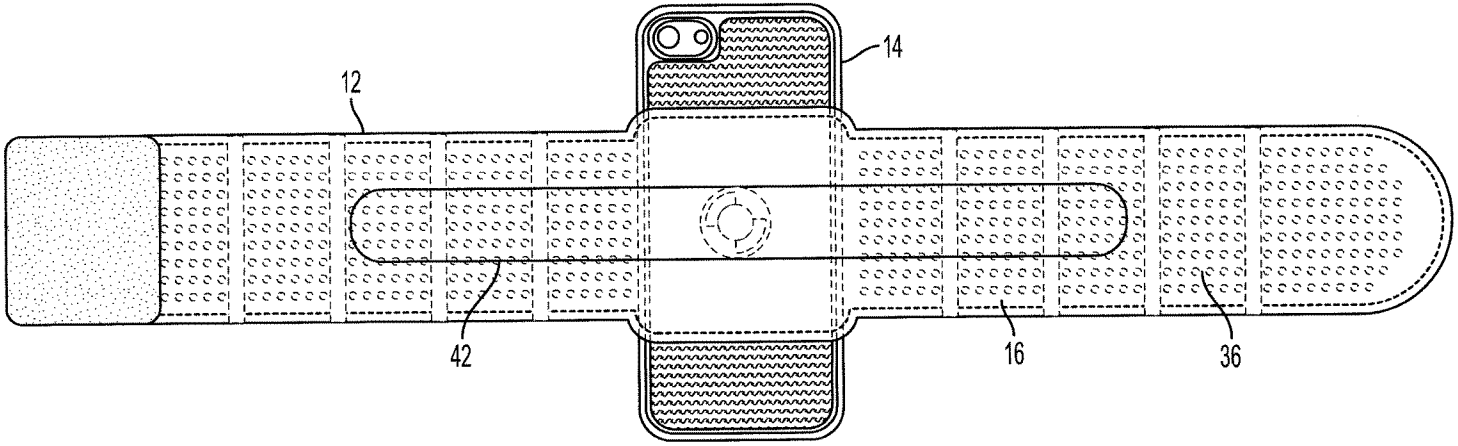
FIG. 2 is a rear view of the armband shown in FIG. 1 with the mobile device housing upon the armband.

FIG. 2 illustrates a rear view of the armband 12, with the inner surface of the spring 16 facing out of the page. The inner surface is configured to face the wearer's arm when the armband 12 is positioned about the arm. The mobile device housing 14 is positioned over the spring 16. A material 36 is covering the inner surface of the spring 16, and a friction tape 42 is coupled to the spring 16.

The material 36 entirely covers the inner surface of the spring 16. The material 36 extends across the inner surface of the spring 16 to join with the material 22 at the edges of the spring 16. The material 36 and material 22 may form a sleeve extending over the surfaces of the spring 16. In one embodiment, the material 36 may cover a part of the inner surface of the spring 16. In one embodiment, the material 36 may be used as material covering the outer surface of the spring 16. In one embodiment, the material 36 may cover the inner surface and outer surface of the spring 16, or may form a sleeve extending entirely over inner and outer surfaces of the spring 16.

The material 36 may be a material that serves to draw moisture away from the wearer's arm. The material 36 may be a moisture wicking material or moisture resistant fabric. The material 36 may serve to draw moisture away from the wearer's arm through a wicking process, in which capillary forces draw the moisture away from the wearer's arm. The moisture may evaporate from the material 36, or may pass to material 22 for evaporation, or may evaporate through perforations 24 in the material 22. The material 36 may be any natural or synthetic fiber that is capable of wicking moisture away from the skin, such as wool, polyester, or Teflon. Wicking materials may include materials that encourage capillary action, that is, the material uses tube-shaped patterns to encourage water to move away from the skin and reduce moisture buildup. In one embodiment, the material 36 may be configured to grip the wearer's skin. In one embodiment, the material 36 may be a microfiber. In one embodiment, the material 36 may be a protective material, that is made of any durable and flexible fabric or material composite, such as a thin stretchable neoprene, compression fabric, mesh cloth, Lycra, or rubber. In one embodiment, a different material may be used for the material 36.

The friction tape 42 is coupled to the spring 16 and is configured to face the wearer's arm when the armband 12 is positioned around the wearer's arm. The friction tape 42 may be positioned upon the material 36. In one embodiment, the friction tape 42 may be directly coupled to the spring 16. The friction tape may include material configured to grip the wearer's arm, to reduce movement of the armband 12 when the armband 12 is positioned on the wearer's arm. The friction tape 42 may be made of a fabric or synthetic material which possesses a high coefficient of friction, providing resistance against slippage and thereby helping secure the armband 12 against the arm.

Figure 3:
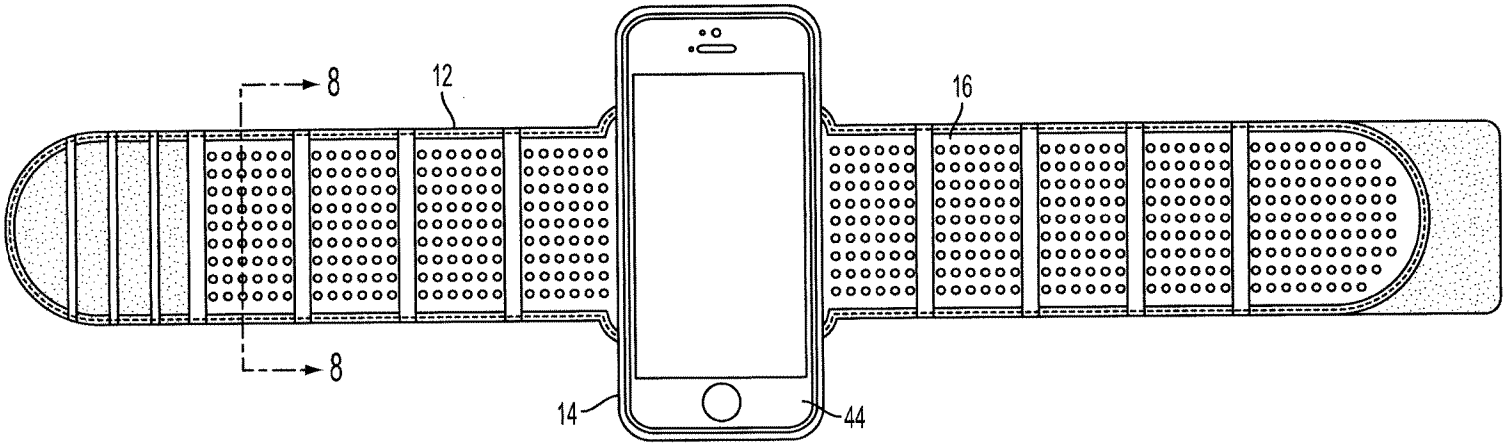
FIG. 3 is a front view of the armband and mobile device housing in the position shown in FIG. 2.

FIG. 3 illustrates a front view of the armband 12, showing the mobile device housing 14 positioned over the spring 16 prior to being locked to the spring 16.

Figure 6:
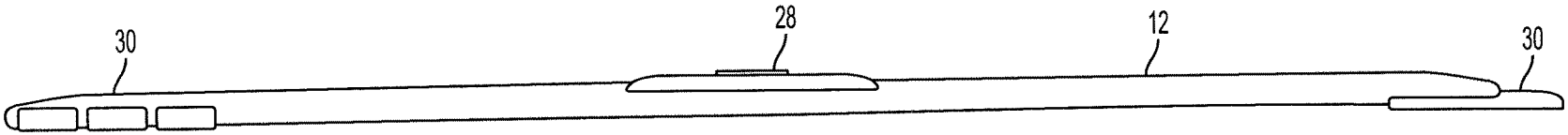
FIG. 6 is a side view of the armband shown in FIG. 1.

FIG. 6 illustrates a side view representation of the armband 12 in the straightened position shown in FIG. 1. The spring 16 that is within the armband may have a shape that is curved concave upward. The curvature of the spring 16 may maintain the spring 16 in the straightened position.

Figure 7:
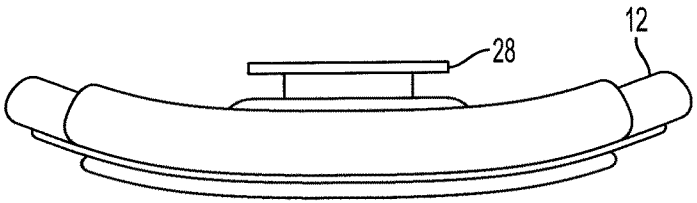
FIG. 7 is an end view of the armband as shown in FIG. 6.

FIG. 7 illustrates an end view of the armband 12 shown in FIG. 6. The mount 28 is shown as a protrusion extending from the armband 12.

FIG. 8 illustrates a cross section of the armband 12 shown in FIG. 1, taken along the width of the armband 12 as marked in FIG. 3. The armband 12 is in the straightened position. The material 22 and material 36 cover the respective outer 46 and inner 48 surfaces of the spring 16. The material 22 and material 36 join to each other at the edges of the spring 16. A rubber coating 50 may extend over the outer and inner surfaces of the spring 16. The rubber coating 50 may provide cushioning for the wearer against the spring 16, and may protect the wearer from direct contact with the spring 16. In one embodiment, the rubber coating 50 may extend over a part of the spring 16. In one embodiment, the rubber coating 50 may be substituted with another material that providing sufficient protection or cushioning for the wearer against the spring 16.

In the straightened position shown in FIG. 8, the spring 16 has a shape along the width of the armband 12 that is curved concave upward. The concave upward curvature of the spring 16 assists to retain the spring 16 in the straightened position. Upon a force being applied to the spring 16, the concave upward curvature of the spring 16 is disrupted. The spring 16 may be drawn to the position shown in FIG. 9, in which the spring 16 has a concave downward curvature along the width of the armband 12. The spring 16 with a concave downward curvature is drawn toward a coil configuration as shown in FIG. 20. In one embodiment, the curvature or structure of the spring 16 may vary from the configurations shown in FIGS. 8 and 9 to result in the straightened and coil positions.

Figure 10:
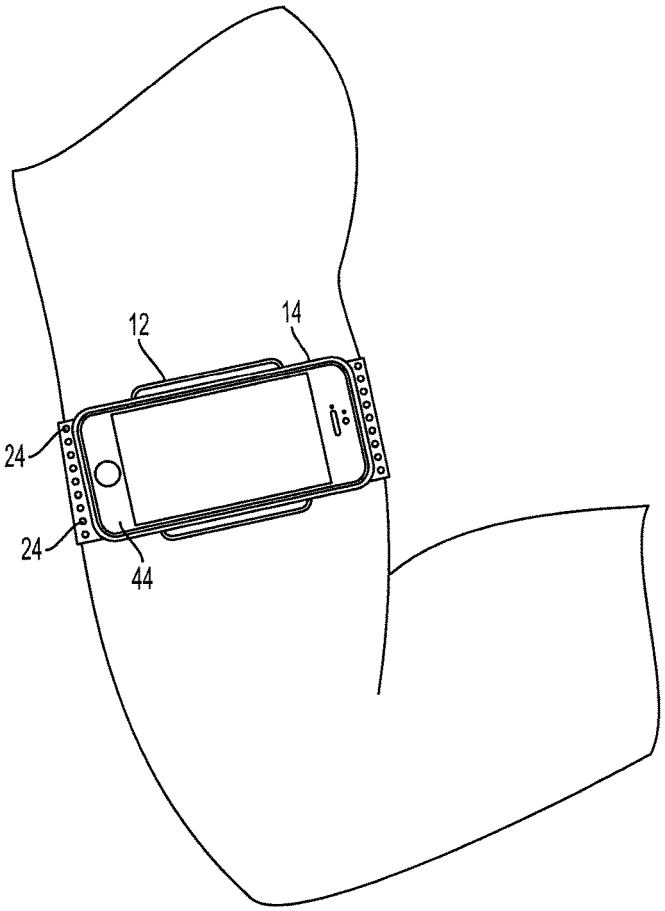
FIG. 10 is a perspective view of the armband shown in FIG. 1 in position on a wearer's arm.

FIG. 10 illustrates the armband 12 in position around the wearer's arm. The spring 16 that is positioned within the armband 12 applies a constrictive force to the wearer's arm that holds the mobile device 44 to the wearer's arm. The spring 16 forms a curve for extending about the wearer's arm to hold the armband 12 to the wearer.

In operation, the armband 12 is applied to the wearer's arm by the spring 16 converting from the straightened position shown in FIG. 1 to the curved position shown in FIG. 10. The spring 16 holds the armband 12 to the wearer's arm by the spring 16 being drawn to the coil position shown in FIG. 20. The spring 16 being drawn to the coil position causes the spring 16 to apply a constrictive spring force to the wearer's arm. The spring 16 is preferably drawn to the coil position by a force of contact with the wearer's arm being applied to the spring 16. The spring 16 may be slapped against the wearer's arm when the spring 16 is in the straightened position shown in FIG. 1. The force of contact may disrupt the curved cross section shape of the spring 16 shown in FIG. 8, to cause the spring 16 to move to the cross section shape shown in FIG. 9. The force may be applied to a mid portion of the spring's 16 cross section shape shown in FIG. 8, which causes the ends of the spring 16 to move against the direction of the force and result in the position shown in FIG. 9. As the spring 16 moves to the curved position shown in FIG. 10, an end of the spring 16 may overlap another portion of the spring 16. The overlap may increase the uniformity of the constrictive force of the spring 16 applied to the wearer's arm. The spring 16 is preferably configured to apply a constrictive force sufficient to hold the armband 12 to the wearer's arm, without use of fasteners or other devices for securing the armband 12 to the wearer's arm, even though additional fasteners may be utilized for further securement.

The material 36 in the form of a material for drawing moisture away from the wearer's arm, may serve to enhance the grip between the armband 12 and the wearer's arm. The material 36 may reduce moisture and slippage of the armband on the wearer's arm. In an embodiment in which the material 22 is a smooth material, the material 22 may allow the armband 12 to more easily wrap around the wearer's min, by reducing friction between the material 22 and material 36 when the materials 22, 36 overlap.

The mobile device housing 14 may attach to the armband 12 either prior to or after the armband 12 is positioned around the wearer's arm. The mobile device housing 14 is attached to the armband 12 by the mobile device housing 14 being rotated upon the mount 28 as shown in FIGS. 4 and 5. The mobile device housing 14 is removed from the armband 12 by the operation shown in FIGS. 4 and 5 being reversed.

The armband 12 beneficially allows for rapid attachment of a mobile device to the wearer's upper arm. The armband 12 is structured such that the armband 12 may be hit or slapped against the wearer's upper arm to allow the spring 16 to automatically wrap around the wearer's upper arm. The armband 12 preferably does not utilize separate straps or other strap-like fasteners, or openings or eyelets for securing the spring 16 in position using a strap, cord, buckle, or cable, which reduces the effort required to size the armband 12 to the wearer's arm. In addition, if the fasteners 30 are not applied, or in an embodiment in which the armband includes no fasteners 30, or in which a portion of the armband 12 may stretch along the length of the spring 16, then the armband 12 may beneficially expand and contract with the muscles of the upper arm without requiring adjustment. For example, in a workout in which the wearer's bicep is increasing or decreasing in size, the spring-like nature of the armband 12 will automatically allow the armband 12 to stay in place without the armband or any separate straps or strap-like devices requiring adjustment.

This feature accounts for the unique problem of muscle swell and contraction found with upper armbands. The overlap of the end of the armband allows a more uniform force to be applied as the armband 12 moves with the swelling and contraction of the upper arm muscles.

The mobile device housing 14 in the form of a mobile device case as shown in FIG. 1, beneficially allows the mobile device to be quickly connected to the armband 12 yet still be used as a protective case upon removal from the armband 12. The structure of the connector device 38 does not add bulk to the mobile device housing 14. The mobile device housing 14 may be removed from the armband 12 and placed in the wearer's pocket for use as a protective case if desired. In addition, a protective case such as a hard case or polycarbonate case additionally does not absorb moisture as other cloth or pouch-like devices for securing mobile devices to armbands may. The mobile device housing 14 lacks large cavities that may store moisture. Such a property may be desirable if moisture from the wearer's arm is being drawn away from the arm through a moisture absorbing material 36.

Figure 11:
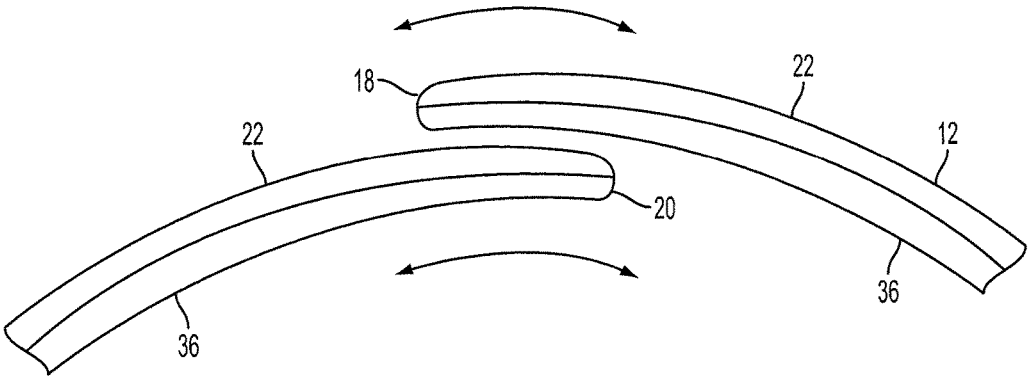
FIG. 11 is a top view of the ends of the armband in position on a wearer's arm.

FIG. 11 illustrates a top view of the ends 18, 20 of the spring 16 when the armband 12 is positioned around the wearer's bicep. One of the ends 18 overlaps the length of the spring 16. The other end 20 is covered by the portion of the spring 16 that leads to the other end 18 of the spring 16. The overlap of the spring 16 causes the spring 16 to have a coil shape or ring shape around the wearer's arm. The overlap of the spring 16 allows for a radially inward force to be applied to the wearer's upper arm. The material 36 at one end 18 of the spring 16 covers the material 22 at the other end 20 of the spring 16. If the fasteners 30 are not joined to each other, or are not tightly joined to each other, or in an embodiment in which fasteners are not used to hold the ends 18, 20 of the springs 16 together, or in an embodiment in which a portion of the armband 12 may stretch along the length of the spring 16, then the ends 18, 20 may slide relative to each other. The relative sliding movement of the ends 18, 20 of the spring 16 may accommodate swelling or contraction of the wearer's upper arm. The diameter of the spring 16 and armband 12 varies according to the varied diameter of the upper arm.

Figure 12:
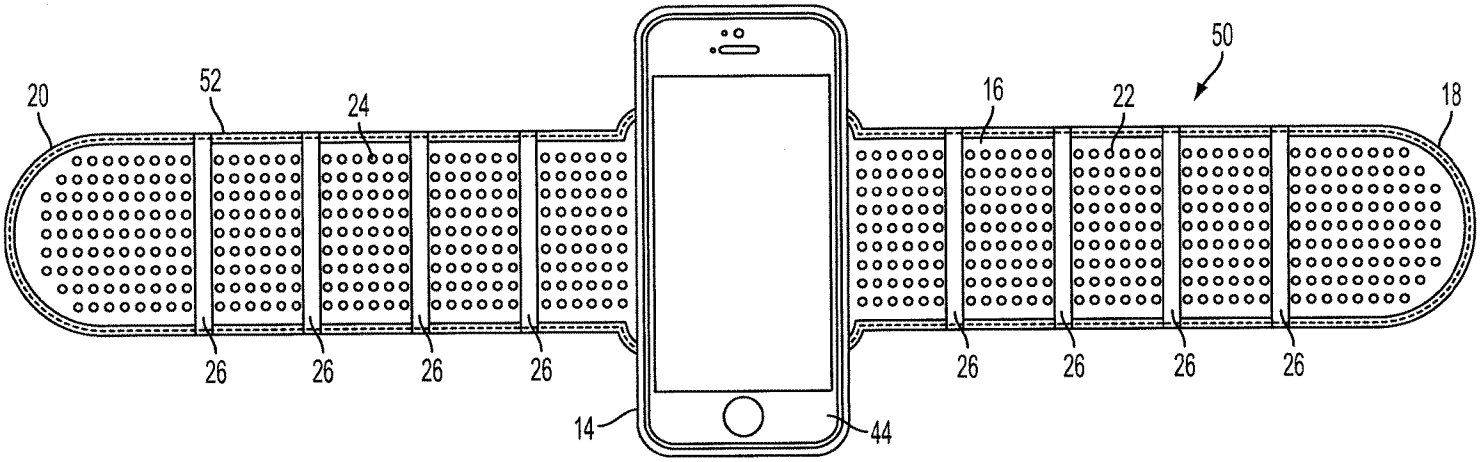
FIG. 12 is a front view of a system including an armband and a mobile device housing according to an embodiment of the disclosure.

FIG. 12 illustrates an embodiment of a system 50 for mounting a mobile device to a wearer's arm including an armband 52 and a mobile device housing 14. In this embodiment, like elements are marked with like reference numbers as other embodiments described in this application. In this embodiment, the fasteners 30 shown in FIG. 1 for example, are not provided with the armband 52.

Figure 13:
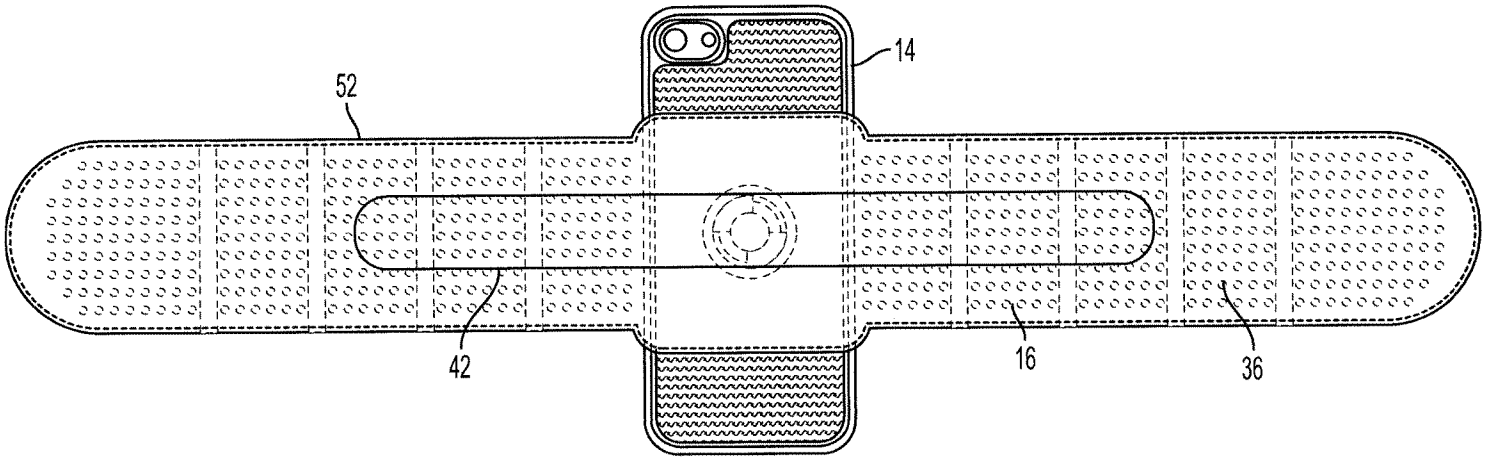
FIG. 13 is a rear view of the system shown in FIG. 12.

FIG. 13 illustrates a rear view of the armband 52 embodiment shown in FIG. 12.

Figure 14:
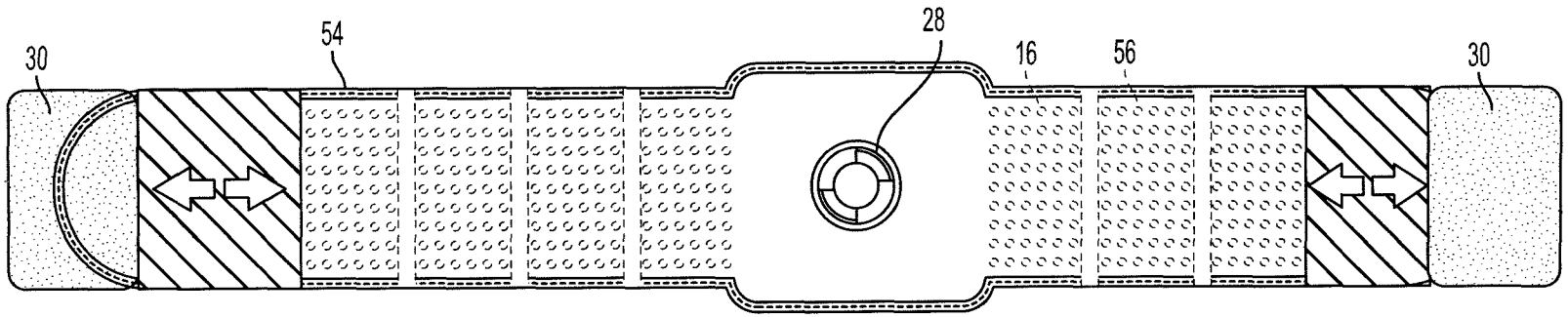
FIG. 14 is a front view of an armband according to an embodiment of the disclosure.

FIG. 14 illustrates an embodiment of an armband 54 for use with a mobile device housing 14 as shown in FIG. 1 for example. In this embodiment, like elements are marked with like reference numbers as other embodiments described in this application. In this embodiment, the material 56 covering the spring 16 may be configured to stretch to accommodate expansion or contraction of the wearer's upper arm. In one embodiment, the spring 16 may be constructed of material that is configured to stretch along the length of the spring 16, to accommodate expansion or contraction of the wearer's upper arm. In one embodiment, the fasteners 30 may be constructed of material that is configured to stretch along the length of the spring 16, to accommodate expansion or contraction of the wearer's upper arm.

Figure 15:
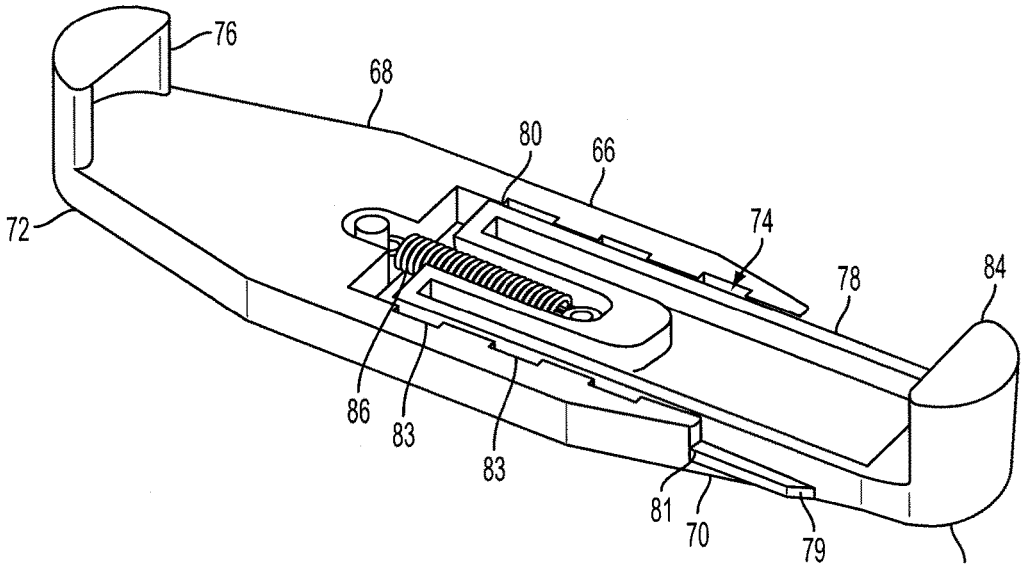
FIG. 15 is a front perspective view of a mobile device housing according to an embodiment of the disclosure.

FIG. 15 illustrates an embodiment of the mobile device housing 66 in which the mobile device housing 66 is configured as a clip for holding a mobile device. The mobile device housing 66 includes an arm 68 having two ends 70, 72. A slot 74 is positioned at one of the ends 70 of the arm 68 and extends through the body of the arm 68. A protrusion 76 is positioned at the other end 72 of the arm 68. The mobile device housing 66 includes another arm 78 having two ends 80, 82. One of the ends 80 is slidably positioned in the slot 74. A protrusion 84 is positioned at the other end 82 of the arm 78. A spring 86 is coupled to the arms 68, 78 and is configured to apply a force to draw the arms 68, 78 towards each other.

The arm 68 has an oblong shape, with the ends 70, 72 of the arm generally aligned along an axis of the arm 68. The slot 74 extends along the axis of the arm 68, in a direction from one end 70 of the arm 68 towards the other end 72 of the arm 68. The slot 74 has an oblong shape to accommodate the shape of the other arm 78.

The protrusion 76 extends from the arm 68 in a direction substantially perpendicular to the axis of the arm 68. The protrusion 76 is shaped as a cup, or a concave surface that is configured to abut a corner of the mobile device. The concave surface may allow the protrusion 76 to extend around the corner of the mobile device to provide greater contact surface area and securing of the mobile device to the mobile device housing 66. In one embodiment, the protrusion 76 may be shaped as a series of pylons, or have another shape that allows the protrusion to abut the corner of the mobile device.

The arm 78 has an oblong shape, with the ends 80, 82 of the arm generally aligned along an axis of the arm 68. The arm 78 has a shape configured to extend into and slide within the slot 74 of the other arm 68. The arm 78 may be configured to slide within the slot 74 such that the arm 78 slides in a direction along the axis of the arm 68. The arm 78 may include flanges 79 at the edges of the arm 78 that extend into grooves 81 along sidewalls of the slot 74. The flanges 79 may assist to retain and guide the arm 78 as it moves within the slot 74. The sidewalls may also include recess 83 that portions of the arm 78 may extend into to lock the arm 78 in position relative to the other arm 68 if desired. The arms 68, 78 in combination may form an oblong shape, with the respective axes of the arms 68, 78 aligned.

The protrusion 84 extends from the arm 78 in a direction substantially perpendicular to the axis of the arm 78. The protrusion 84 is positioned upon the arm 78 such that the protrusion 84 is positioned in line with the protrusion 76 of the other arm 68, along the axes of the arms 68, 78. The protrusion 84 is shaped as a cup, or a concave surface that is configured to abut a corner of the mobile device. The concave surface may allow the protrusion 84 to extend around the corner of the mobile device to provide greater contact surface area and securing of the mobile device to the mobile device housing 66. In one embodiment, the protrusion 84 may be shaped as a series of pylons, or have another shape that allows the protrusion to abut the corner of the mobile device.

The spring 86 is positioned within the slot 74 and has ends coupled to the respective arms 68, 78. The spring 86 is configured to draw arms 68, 78 and respective protrusions 76, 84 towards each other. The spring 86 as shown in FIG. 15 is a coil spring. In one embodiment, the spring 86 may be shaped as another form of biasing device configured to draw the arms 68, 78 and respective protrusions 76, 84 towards each other.

Figure 16:
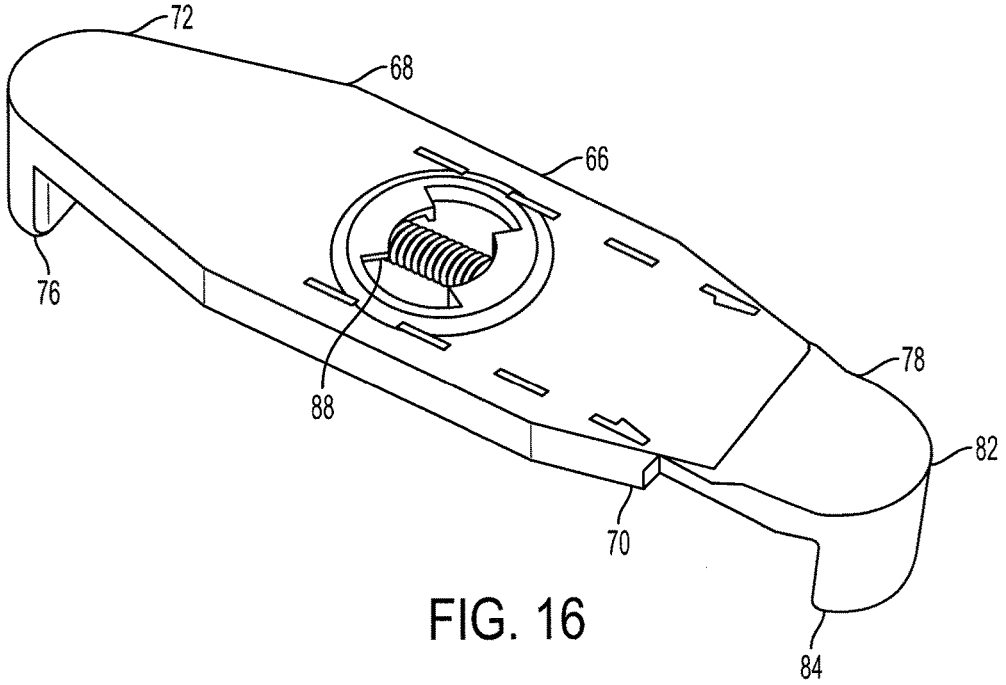
FIG. 16 is a rear perspective view of the mobile device housing shown in FIG. 15.

FIG. 16 is a back view of the mobile device housing 66. The mobile device housing 66 includes a connector device 88 upon the back of the arm 68. The connector device 88 may be configured similarly as the connector device 38 shown in FIG. 1. The connector device 88 may be a twist lock device that rotates upon the mount 28 shown in FIG. 1 for example, to lock the mobile device housing 66 to the mount 28.

In operation, the mobile device housing 66 is configured to hold a mobile device to the housing 66 by abutting the corners of the mobile device. The arms 68, 78 are configured to slide relative to each other to allow different size mobile devices to be held by the same mobile device housing 66. The distance between the protrusions 76, 84 may vary to accommodate different sizes of mobile devices. The spring protrusions 76, 84 may be drawn together by the force applied by the spring 86. The force of the spring 86 retains the mobile device within the housing 66. The fit of the arm 78 into recesses 83 may also serve to retain the mobile device within the housing 66. The mobile device housing 66 beneficially allows various sizes of mobile devices to be quickly joined to the housing 66 for connection to the armband 12 as shown in FIG. 1 for example. In one embodiment, the mobile device housing 66 may be configured to join to other connecting devices, such as a belt clip or the like.

Figure 17:
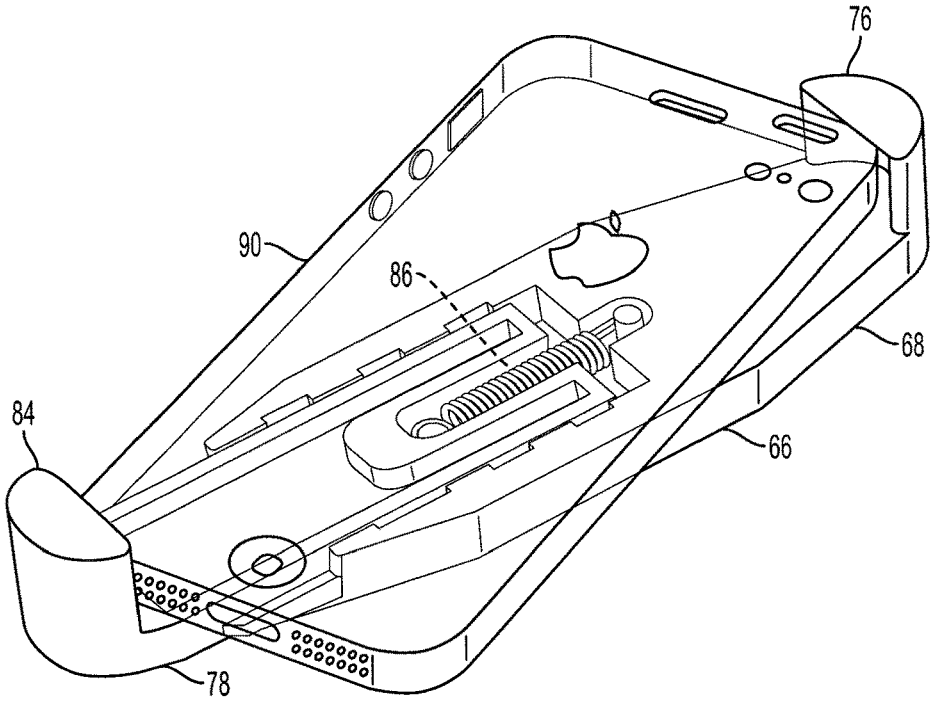
FIG. 17 is a front perspective view of the mobile device housing shown in FIG. 15 with a mobile device attached.

FIG. 17 illustrates a mobile device 90 held to the mobile device housing 66. The spring 86 draws the protrusions 76, 84 towards each other to hold the mobile device 90 to the housing 66. The arms 68, 78 extend diagonally across the mobile device 90.

Figure 18:
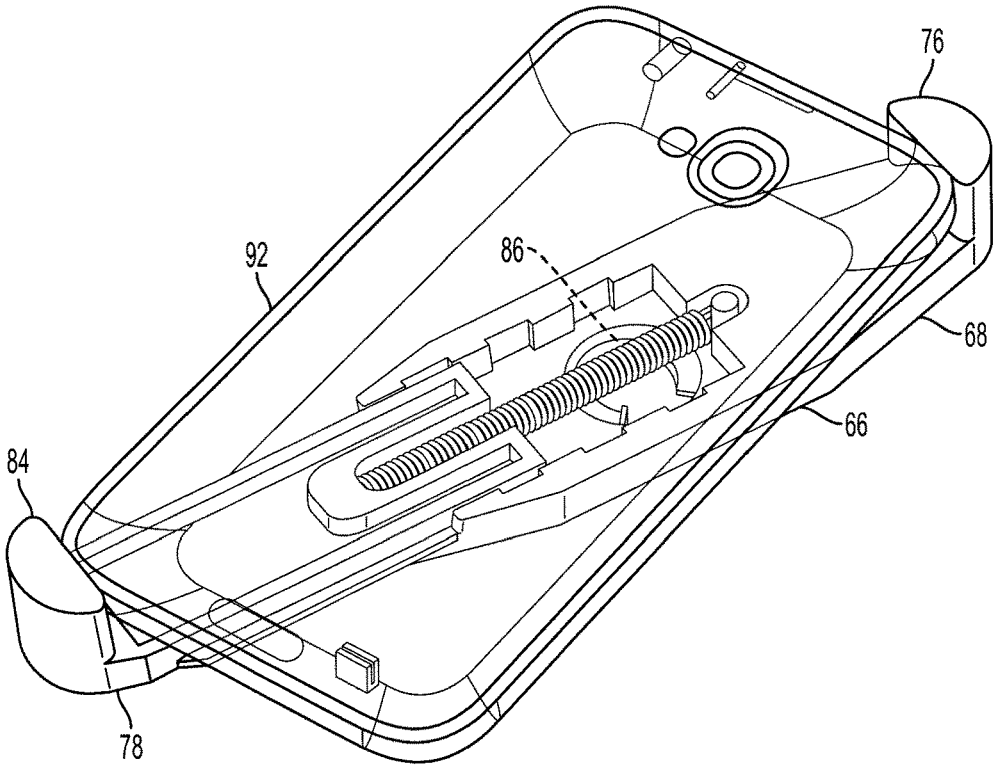
FIG. 18 is a front perspective view of the mobile device housing shown in FIG. 15 with a mobile device attached.

FIG. 18 illustrates a different mobile device 92 than the mobile device shown in FIG. 17, held to the mobile device housing 66. The spring 86 draws protrusions together to hold the mobile device 92 to the housing 66. The arms 68, 78 extend diagonally across the mobile device 92. The mobile device 92 is larger than the mobile device 90 shown in FIG. 17. The variable distance between the protrusions 76, 84 allows both sizes of mobile devices 92, 90 to be held to the same mobile device housing 66.

Figure 19:
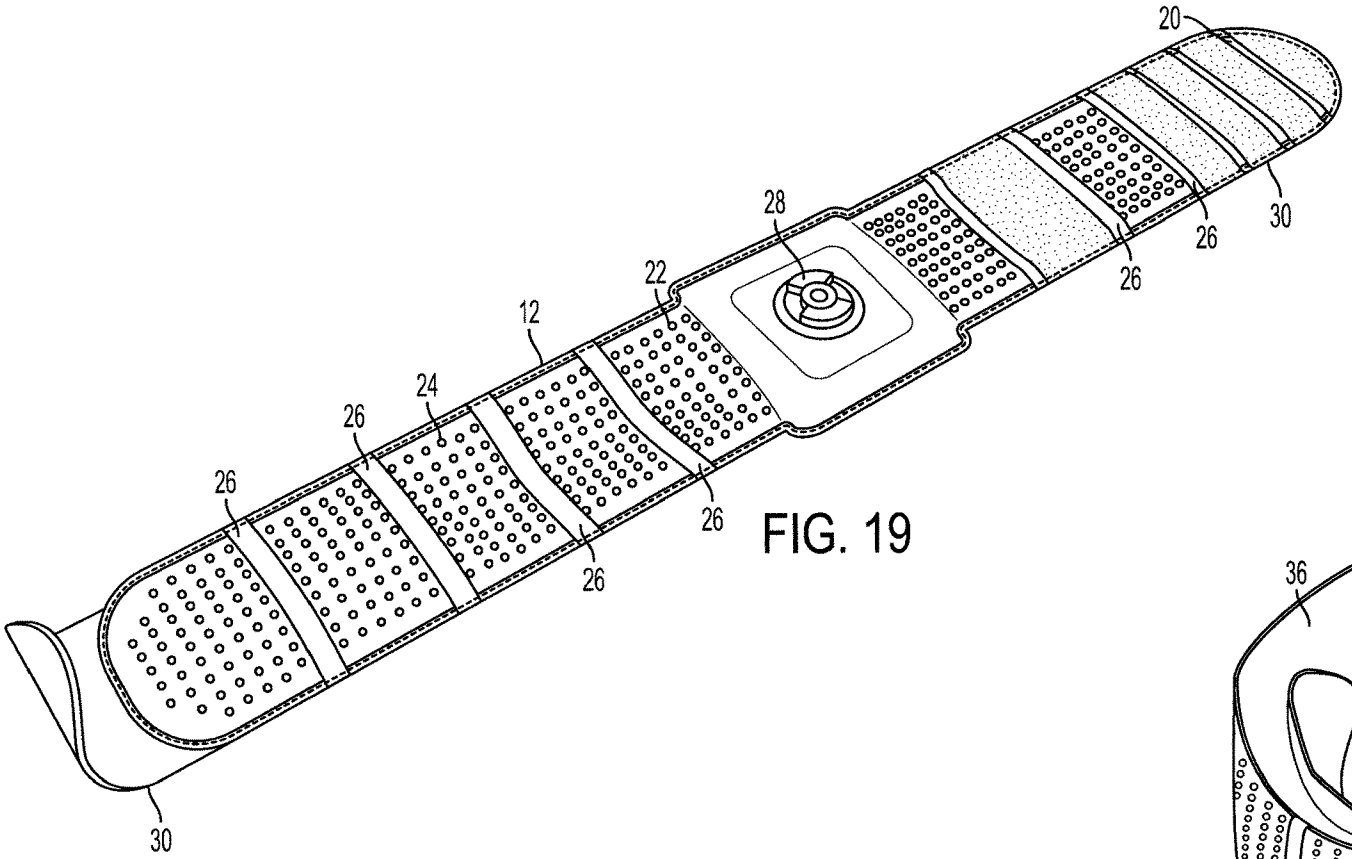
FIG. 19 is a front perspective view of an armband according to an embodiment of the disclosure, in the position shown in FIG. 1.

FIG. 19 illustrates a perspective view of the armband 12 in the form shown in FIG. 1. FIG. 19 illustrates the armband 12 in a straightened position. FIG. 20 illustrates the armband 12 shown in FIG. 19 after it has been drawn to a coil position.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only, and is not intended to limit the scope of the present invention, which is defined solely by the claims. Accordingly, the present invention is not limited to that precisely as shown and described.

Certain embodiments of the present invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

The terms "a," "an," "the" and similar referents used in the context of describing the present invention (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of the present invention so claimed are inherently or expressly described and enabled herein.

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

What is claimed is:

1. A system for mounting a mobile device to a wearer's arm comprising:

a form fit mobile device case including a front side and a back side defining an outermost perimeter of the form fit mobile device case, the back side having an aperture and a flat profile without a protrusion, the form fit mobile device case being configured to hold the mobile device and lay flat on a flat surface when the back side contacts the flat surface; and an armband including:

an elongate bistable spring having a first end and a second end and a central location therebetween and a length between the first end and the central location and a length between the second end and the central location, the spring configured to move between a first position in which the spring forms a curve for extending about the wearer's arm to hold the armband to the wearer and a second position in which the spring is straightened from the first position to release the armband from the wearer's arm, the spring having an inner surface for facing the wearer's arm and an outer surface facing opposite the inner surface, a moisture wicking material coupled to the spring and covering the inner surface of the spring along the length of the spring between the first end and the central location and along the length of the spring between the second end and the central location, the moisture wicking material being configured to draw moisture away from the wearer's arm, and a protrusion coupled to the spring at the central location and extending outward from the spring, and configured to insert into the aperture of the form fit mobile device case to releasably connect the form fit mobile device case to the spring and hold the mobile device in a position radially outward from the central location of the spring when the spring is in the first position.

2. The system of claim 1, wherein the spring is sized to extend about the wearer's arm above the elbow such that a portion of the spring overlaps another portion of the spring when the spring is in the first position about the wearer's arm above the elbow.

3. The system of claim 1, wherein the spring has a coil shape in the first position.

4. The system of claim 1, wherein the spring has a concave shape across a width of the spring that maintains the spring in the second position.

5. The system of claim 1, wherein the spring is configured to hold the armband to the wearer in the first position without the first end being releasably tethered to the second end.

6. The system of claim 5, wherein the armband includes fasteners for securing the spring in the first position.

7. The system of claim 1, wherein the form fit mobile device case is shaped to cover a back surface and side surfaces of the mobile device and expose a screen on the front surface of the mobile device to allow the wearer to directly touch the screen when the mobile device is inserted into the form fit mobile device case.

8. The system of claim 1, wherein the protrusion is a twist lock device configured to twist relative to the aperture of the form fit mobile device case to releasably connect the form fit mobile device case to the spring.

9. The system of claim 1, wherein the armband further comprises a strip of friction material being coupled to the moisture wicking material and having a surface with a coefficient of friction greater than that of the moisture wicking material and configured to contact the wearer.

10. The system of claim 1, wherein the armband has a length of between approximately 8 and 16 inches and a width of between approximately 1 and 2 inches.

11. The system of claim 1, wherein the moisture wicking material includes perforations or apertures extending through the surface of the material for reducing a weight of the material and improving moisture evaporation.

12. The system of claim 1, wherein the armband further comprises a rubber layer between the elongate bistable spring and the moisture wicking material, the rubber layer configured to provide cushioning for the wearer against the elongate bistable spring, and protect the wearer from direct contact with the elongate bistable spring.

13. A system for mounting a mobile device to a wearer's arm comprising:

a clip including a front side, a back side, a first arm, and a second arm, the front side and the back side defining an outermost perimeter of the clip, the back side having an aperture and a flat profile without a protrusion and being configured to lay flat on a flat surface, and the first arm and the second arm configured to apply pressure to the mobile device to hold the mobile device to the clip; and an armband including:

an elongate bistable spring having a first end and a second end and a central location therebetween and a length between the first end and the central location and a length between the second end and the central location, the spring configured to move between a first position in which the spring forms a curve for extending about the wearer's arm to hold the armband to the wearer and a second position in which the spring is straightened from the first position to release the armband from the wearer's arm, the spring having an inner surface for facing the wearer's arm and an outer surface facing opposite the inner surface, a moisture wicking material coupled to the spring and covering the inner surface of the spring along the length of the spring between the first end and the central location and along the length of the spring between the second end and the central location, the moisture wicking material being configured to draw moisture away from the wearer's arm, and a protrusion coupled to the spring at the central location and extending outward from the spring, and configured to insert into the aperture of the clip to releasably connect the clip to the spring and hold the mobile device in a position radially outward from the central location of the spring when the spring is in the first position.

14. The system of claim 13, wherein the armband further comprises a strip of friction material being coupled to the moisture wicking material and having a surface with a coefficient of friction greater than that of the moisture wicking material and configured to contact the wearer.

15. The system of claim 13, wherein:

the first arm of the clip has a first end and a second end, with a slot in the first end of the first arm;

a first protrusion extends from the second end of the first arm and is configured to abut a first corner of the mobile device;

the second arm of the clip has a first end and a second end, the first end of the second arm being slidably positioned in the slot;

a second protrusion extends from the second end of the second arm and is configured to abut a second corner of the mobile device that is diagonal across the mobile device from the first corner; and a spring is coupled to the first arm and to the second arm and is configured to apply a force to the second arm to slide the second protrusion towards the first protrusion, whereby the mobile device is held to the clip by the first protrusion abutting the first corner of the mobile device and by the second protrusion abutting the second corner of the mobile device.

16. The system of claim 15, wherein the first arm has a length between the first end of the first arm and the second end of the first arm, and the second arm is configured to slide relative to the first arm in a direction along the length of the first arm.

17. The system of claim 16, wherein the first end of the second arm is configured to slide in the slot to allow the second arm to slide relative to the first arm.

18. The system of claim 15, wherein the first end of the first arm and the second end of the first arm are positioned along an axis, and the second arm is configured to slide relative to the first arm in a direction parallel with the axis.

19. The system of claim 15, wherein the first protrusion includes a concave surface configured to abut the first corner of the mobile device.

20. The system of claim 15, wherein the clip is configured to extend diagonally across the mobile device when the mobile device is held to the clip by the first protrusion abutting the first corner of the mobile device and by the second protrusion abutting the second corner of the mobile device.

* * * * *